US009913537B2

(12) United States Patent
Piretti

(10) Patent No.: US 9,913,537 B2
(45) Date of Patent: Mar. 13, 2018

(54) FOLDING CHAIR

(71) Applicant: PRO-CORD S.p.A., Bologna (IT)

(72) Inventor: Giancarlo Piretti, Bologna (IT)

(73) Assignee: PRO-CORD S.P.A., Bologna (IT)

( * ) Notice: Subject to any disclaimer, the term of this patent is extended or adjusted under 35 U.S.C. 154(b) by 109 days.

(21) Appl. No.: 15/156,219

(22) Filed: May 16, 2016

(65) Prior Publication Data

US 2016/0338492 A1 Nov. 24, 2016

(30) Foreign Application Priority Data

May 19, 2015 (IT) ..... 102015000015872

(51) Int. Cl.
*A47C 4/04* (2006.01)
*A47C 4/24* (2006.01)
*A47C 5/10* (2006.01)

(52) U.S. Cl.
CPC ..... *A47C 4/04* (2013.01); *A47C 4/24* (2013.01); *A47C 5/10* (2013.01)

(58) Field of Classification Search
CPC .... A47C 4/04; A47C 4/10; A47C 4/20; A47C 4/24; A47C 5/10
USPC ..... 297/55, 56, 58
See application file for complete search history.

(56) References Cited

U.S. PATENT DOCUMENTS 3,705,744 A 12/1972 Piretti et al.
5,524,966 A 6/1996 Piretti
8,998,321 B2 * 4/2015 Piretti ..... A47C 7/443 297/298
2015/0035332 A1 * 2/2015 Piretti ..... A47C 7/44 297/299
2016/0157615 A1 * 6/2016 Piretti ..... A47C 7/44 297/301.1

(Continued)

FOREIGN PATENT DOCUMENTS

EP 3095354 A1 * 11/2016 ..... A47C 4/04
FR 476966 A 9/1915

(Continued)

OTHER PUBLICATIONS

Italian Search Report and Written Opinion dated Feb. 5, 2016 for Application No. UB20150837.

*Primary Examiner* — Robert Canfield
(74) *Attorney, Agent, or Firm* — Patterson & Sheridan, L.L.P.

(57) ABSTRACT

A folding chair comprising a seat and a backrest carried by a folding structure, wherein the folding structure comprises a first structure defining a pair of front legs and a second structure defining a pair of rear legs, articulated to each other about a transverse axis by means of a pair of joints and movable relative to one another between an open position and a closed position, wherein the first structure comprises two first side elements and the second structure comprises two second side elements and wherein each of said joints comprises a first half-joint fixed to a respective first side element and a second half-joint fixed to a respective second side element, wherein the first and the second half-joints are rotatable relative to one another about said transverse axis, wherein the first structure comprises a pair of rods mounted within respective first side elements and movable between a raised position and a lowered position.

8 Claims, 10 Drawing Sheets

(56) References Cited

U.S. PATENT DOCUMENTS

2017/0172304 A1* 6/2017 Piretti ..... A47C 4/04

FOREIGN PATENT DOCUMENTS

| | | | | |
|---|---|---|---|---|
| FR | 737558 | A | | 12/1932 |
| JP | 2002017501 | A | | 1/2002 |
| JP | 2017113561 | A | * | 6/2017 |

* cited by examiner

FOLDING CHAIR

CROSS-REFERENCE TO RELATED APPLICATIONS

This application claims benefit of Italian patent application number 102015000015872, filed May 19, 2015, which is herein incorporated by reference.

BACKGROUND OF THE INVENTION

Field of the Invention

The present invention relates to a folding chair comprising a folding support structure movable between an open position and a closed position and carrying a seat and a backrest.

Description of Prior Art

The U.S. Pat. No. 3,705,744 by the same inventor describes a folding chair in which the backrest is fixed to a rectangular frame defining the front legs and in which a second U-shaped frame defining the rear legs is articulated to the first frame about a transverse axis. The seat is articulated around the same transverse axis.

The U.S. Pat. No. 5,524,966 by the same owner describes a folding chair provided with three structures defining, respectively, the front legs, the rear legs and the seat, which are mutually articulated about a common transverse axis. The backrest of the chair forms part of a fourth structure separate from said three structures and articulated on one of them about the common axis. In the conditions of use of the chair, the backrest can tilt backwards against the action of a spring.

Folding chairs of this type have the disadvantage that the backrest is aligned to the structure defining the front legs. In the position of use, the backrest forms an angle greater than 90° relative to the seat. This makes the chair more uncomfortable with respect to non-folding chairs in which the backrest is essentially perpendicular to the seat. If, on the other hand, the backrest in a folding chair was essentially perpendicular to the seat in the position of use, in the closed position the chair would have large overall dimensions.

SUMMARY OF THE INVENTION

The present invention aims to provide a chair that, in the position of use, has the same comfort conditions of a rigid chair and that occupies a minimal amount of space in the storage position.

According to the present invention, this object is achieved by a chair having the characteristics forming the subject of claim 1.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
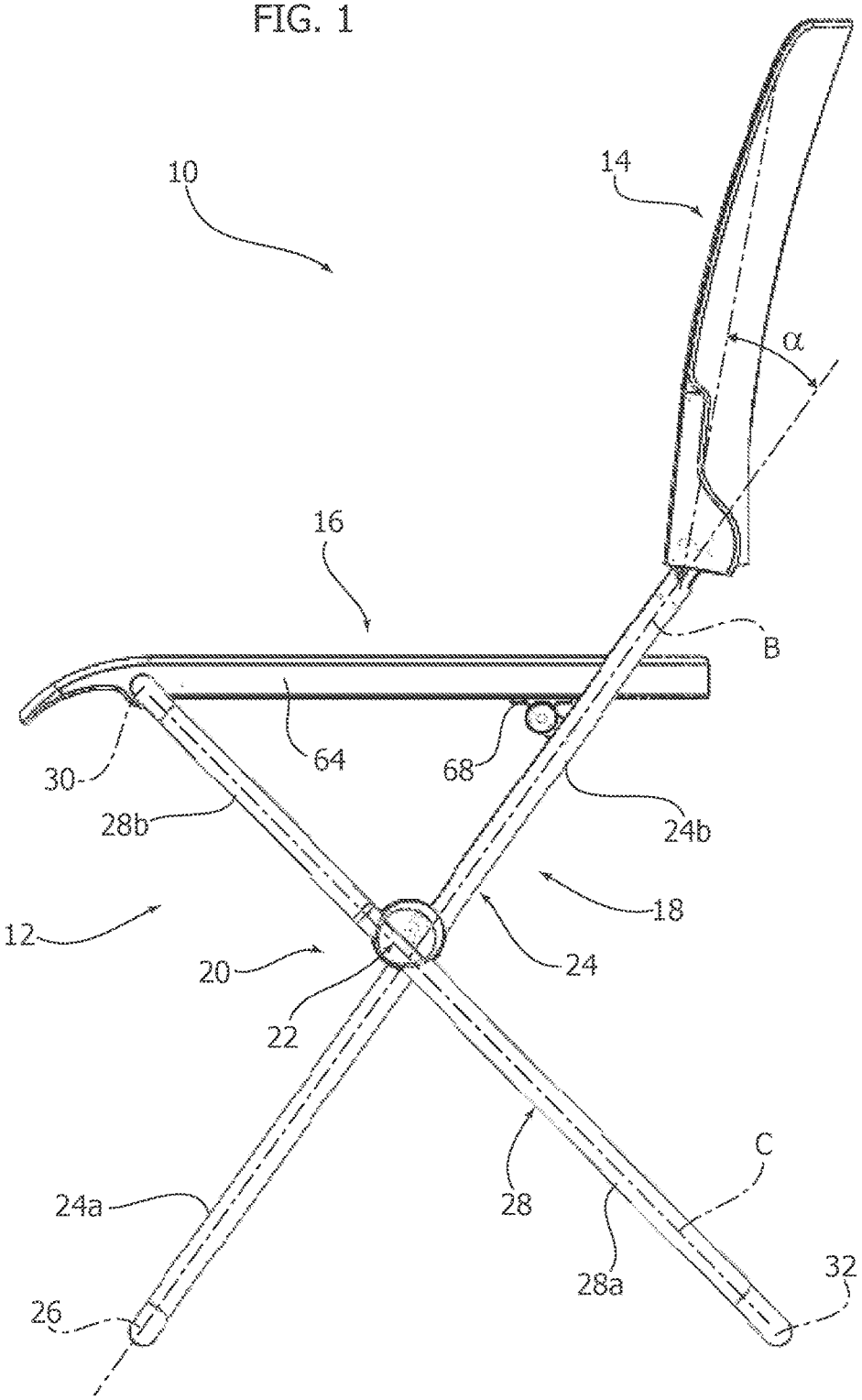
FIG. 1 is a side view of a chair according to the present invention in the open position.
Figure 2:
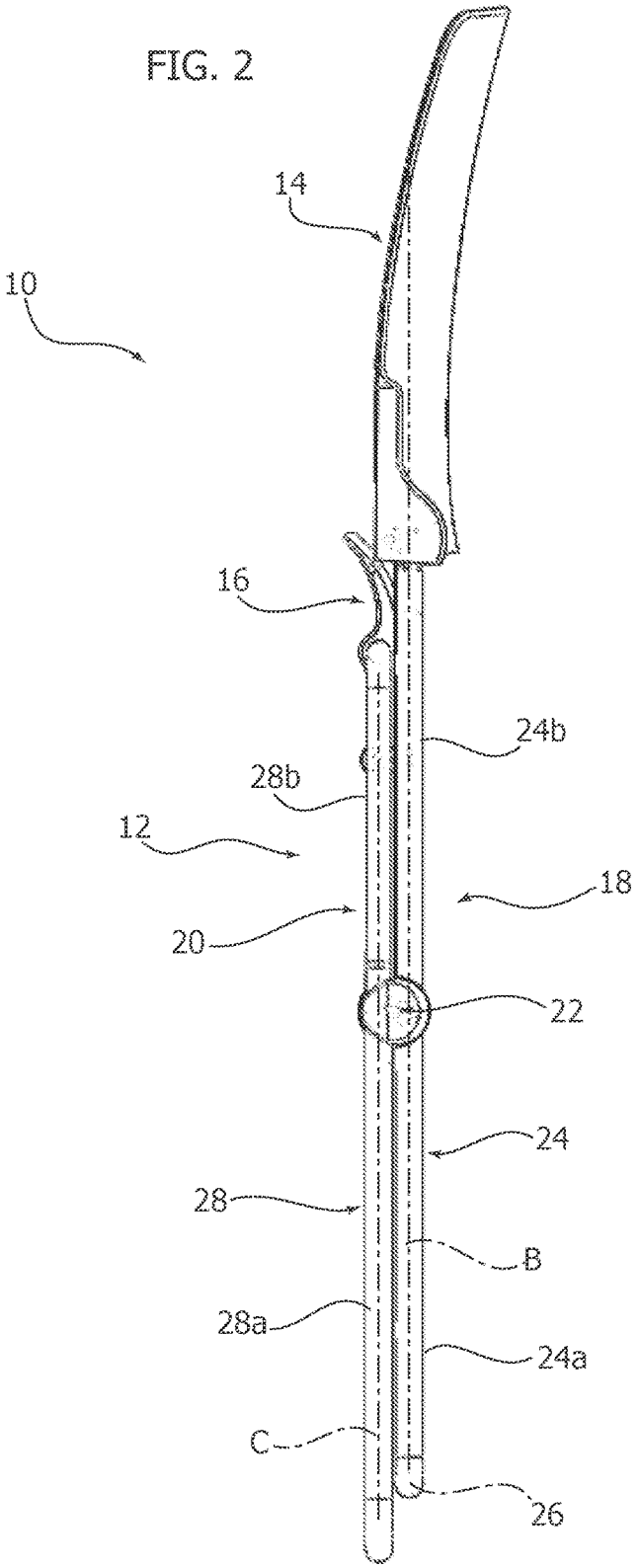
FIG. 2 is a side view of the chair of FIG. 1 in the closed position.
Figure 3:
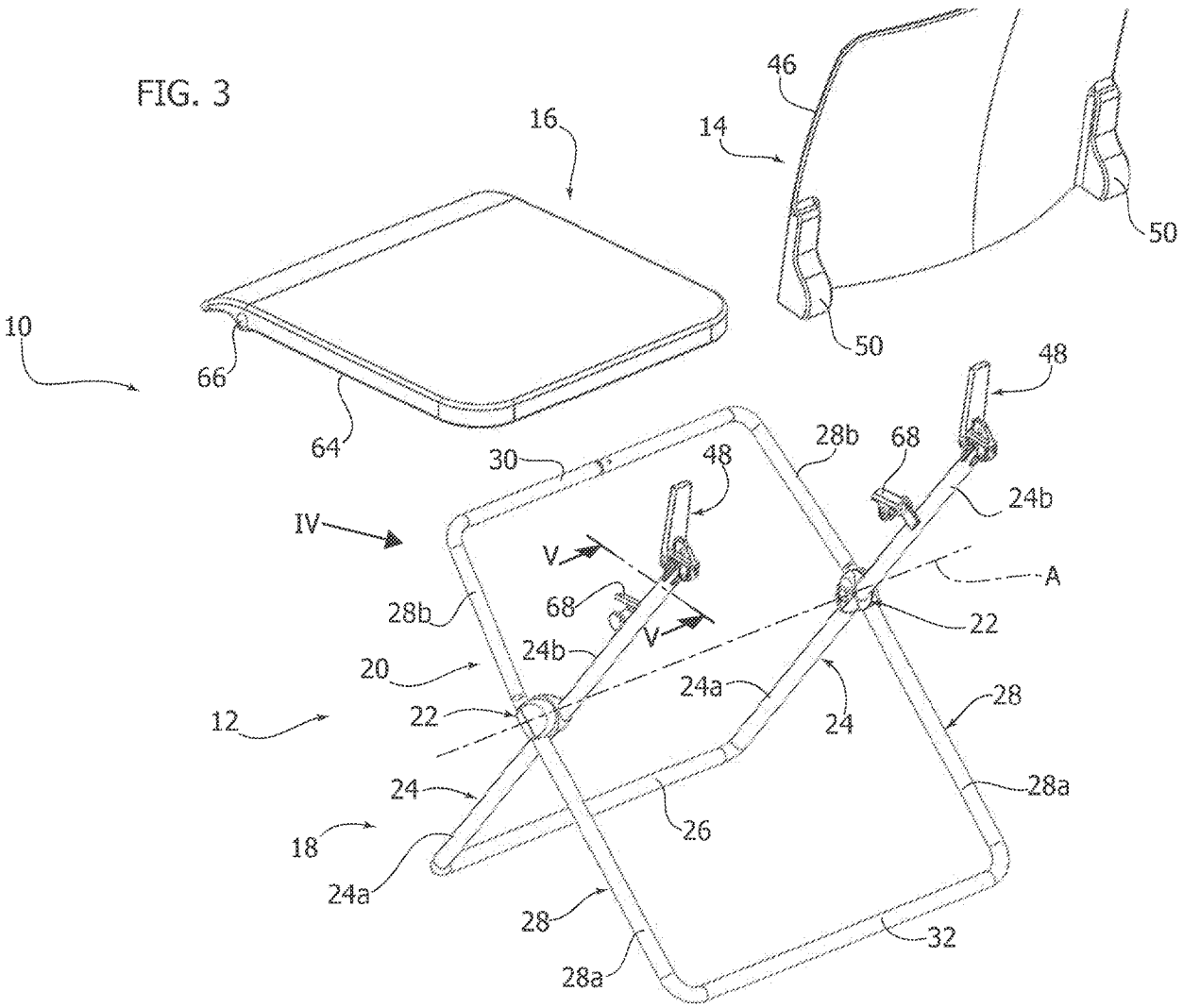
FIG. 3 is a perspective view of the chair according to the invention with the seat and the backrest in an exploded position.

With reference to FIGS. 1 to 3, numeral 10 indicates a folding chair according to the present invention. The chair 10 comprises a folding structure 12 carrying a backrest 14 and a seat 16. The chair 10 is capable of assuming an open position illustrated in FIG. 1 and a closed position illustrated in FIG. 2.

The folding structure 12 comprises a first structure 18 and a second structure 20 articulated to each other about a transverse axis A by means of a pair of joints 22. The first structure 18 essentially has a U-shaped frame and comprises two first side elements 24 parallel to each other and joined at their lower ends by a first transverse element 26. The first side elements 24 have lower portions 24*a* that define the front legs of the chair and upper portions 24*b* that form supports for the backrest 14.

The second structure 20 essentially has the shape of a rectangular frame and comprises two second side elements 28 parallel to each other having respective upper ends joined together by a second transverse element 30 and respective lower ends joined together by a third transverse element 32. The second side elements 28 have lower portions 28*a* that define the rear legs of the chair and upper portions 28*b* that define supports for the seat 16. The first and second side elements 24, 28 and the cross members 26, 30, 32 are formed by tubular elements.

Figure 4:
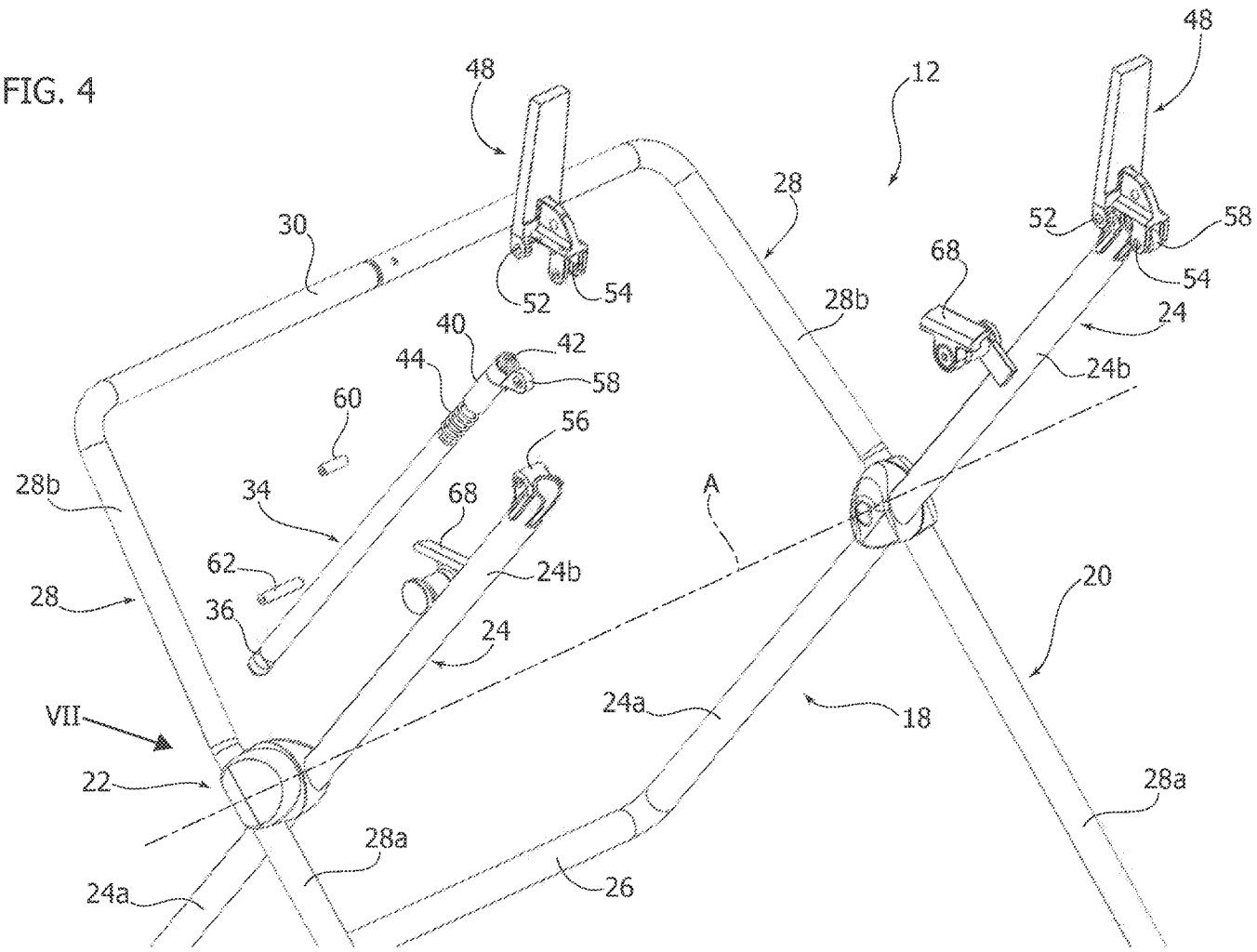
FIG. 4 is a partially exploded perspective view of the part indicated by the arrow IV in FIG. 3.
Figure 5:
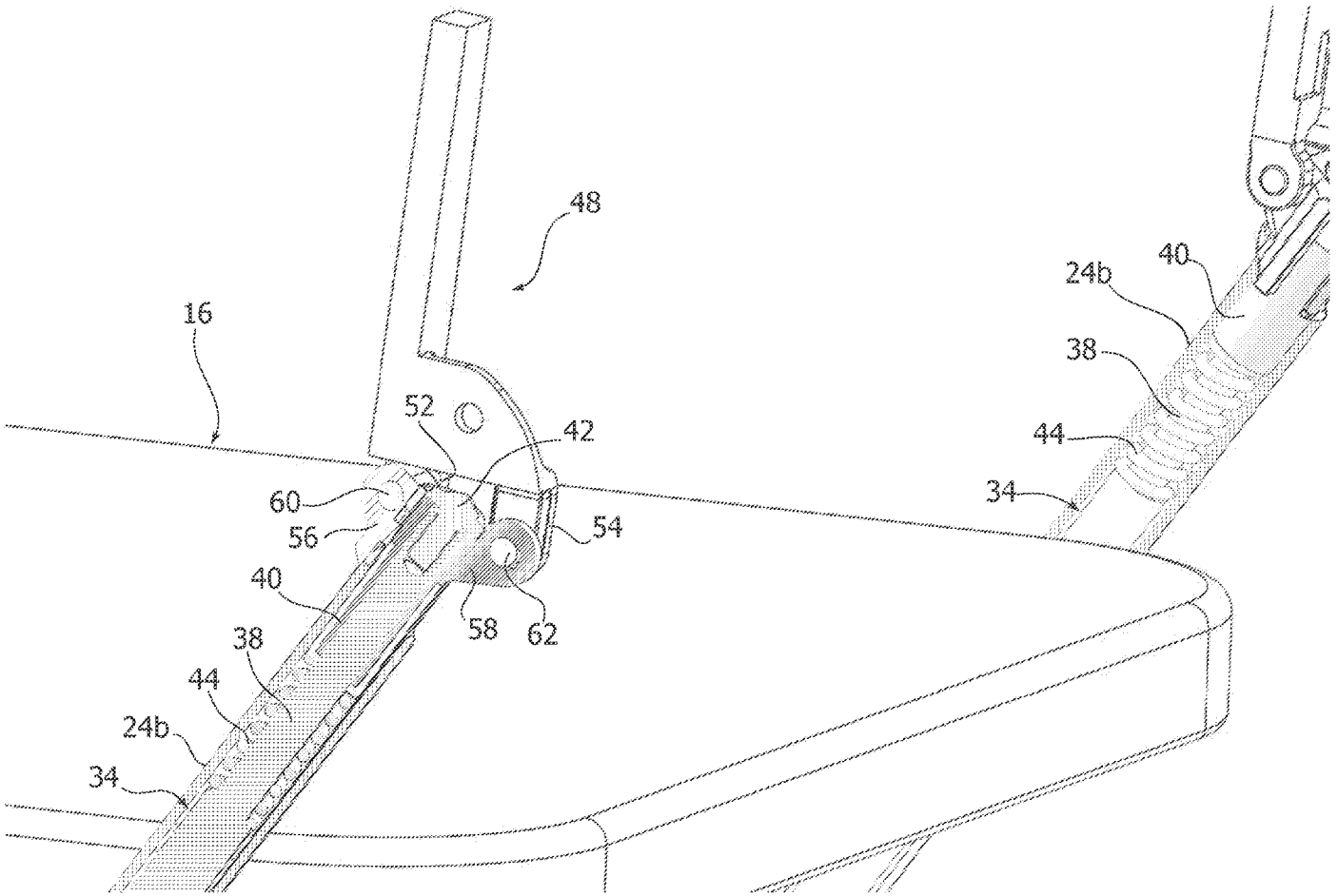
FIGS. 5 and 6 are perspective views in cross-section along the line V-V of FIG. 3 in two positions of the backrest.
Figure 6:
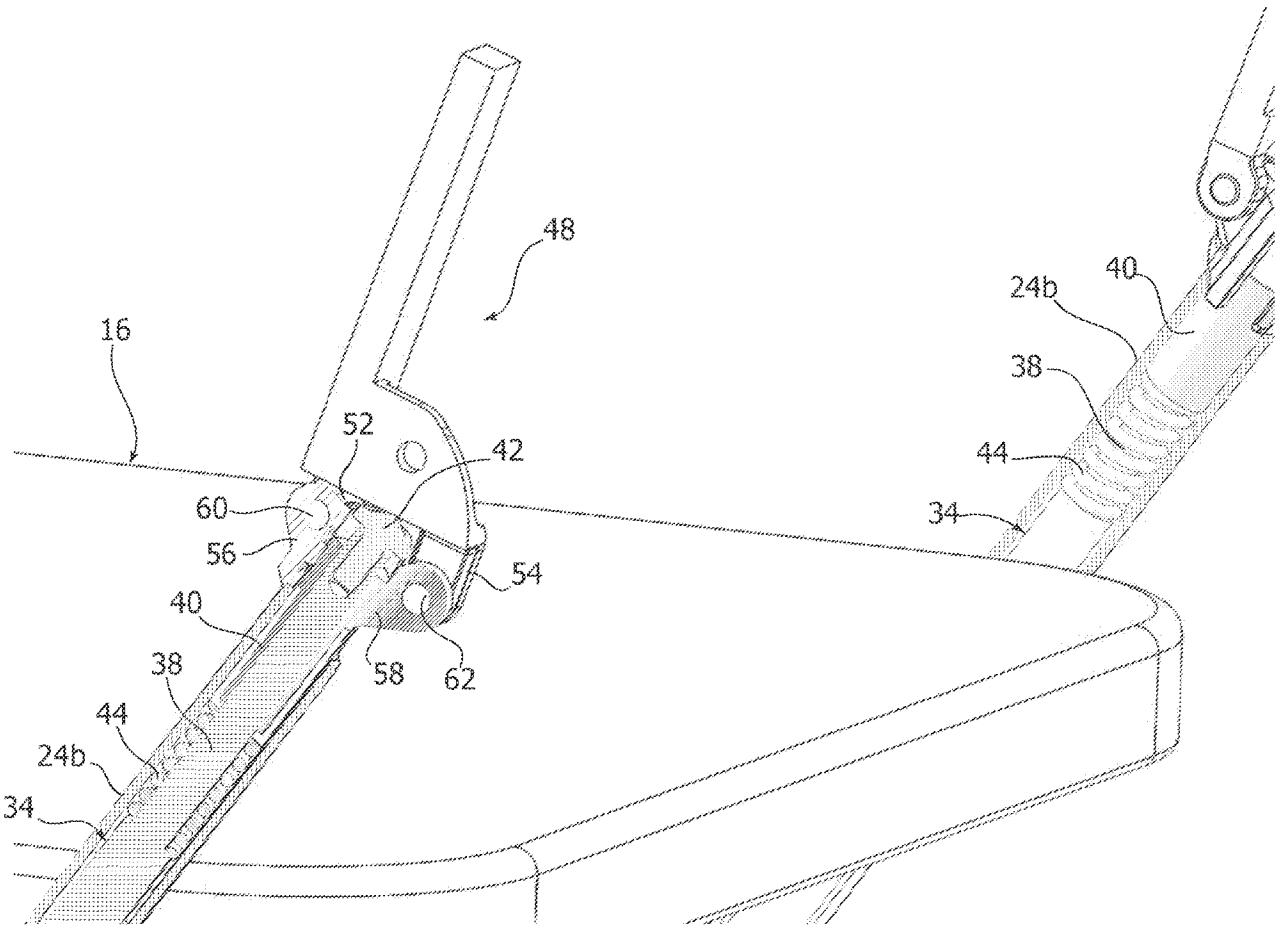

With reference to FIG. 4, respective rods 34 are inserted within the upper portions 24*b* of the first side elements 24. The rods 34 are movable within the upper portions 24*b* between a raised position and a lowered position. Each rod 34 has an engagement portion 36 at its lower end, formed for example by a transverse groove. With reference to FIGS. 4-6, each rod 34 has an upper end portion 38 with a reduced diameter. Each rod 34 comprises a bushing 40 slidably mounted on the respective upper end portion 38. A stop element 42 is fixed to the upper end of the respective upper end portion 38 of the rod 34. A helical compression spring 44 is arranged coaxially to the upper end portion 38 of the respective rod 34 and has opposite ends resting, respectively, against a shoulder of the rod 34 and against a lower front end of the bushing 40. The spring 44 pushes the bushing 40 upwards, into abutment against a head of the stop element 42. The bushing 40 can be pushed downwards along the upper end portion 38 of the rod 34 against the action of the spring 44.

With reference to FIG. 3, the backrest 14 comprises a backrest panel 46 and two supports 48 inserted and fixed within respective seats 50 of the backrest panel 46.

With reference to FIGS. 4 to 6, each support 48 has a front articulation portion 52 and a rear articulation portion 54. The front articulation portion 52 of each support 48 is articulated to a respective first eyelet 56 fixed to the upper end of the respective first side element 24. The second articulation portion 54 is articulated to a second eyelet 58 fixed to or integrally formed with the bushing 40 of the respective rod 34. The articulation portions 52, 54 are articulated to the respective eyelets 56, 58 by means of respective pins 60, 62. The first pin 60 rotatably engages respective holes of the articulation portion 52 and of the corresponding eyelet 56 without radial clearance. The second pin 62 engages the respective eyelet 58 with a certain clearance in the radial direction as shown in FIGS. 5 and 6.

With reference to FIG. 3, the seat 16 has side edges 64 equipped with transverse articulation holes 66 (only one of which is visible in FIG. 3). The holes 66 are engaged in a rotatable manner by the second transverse element 30 of the second structure 20. The front end of the seat 16 is therefore articulated about a transverse axis with respect to the second structure 20. The opposite side edges 64 of the seat 16 engage respective shoes 68 that are carried, in an oscillating manner about a common transverse axis, by the respective upper portions 24*b* of the first side elements 24 of the first structure 18. The shoes 68 are preferably fixed to respective pins that rotatably engage respective bushings fixed to the respective upper portions 24*b*. The shoes 68 support the rear part of the seat 16 and slidably engage the corresponding side edges 64 of the seat 16.

Figure 7:
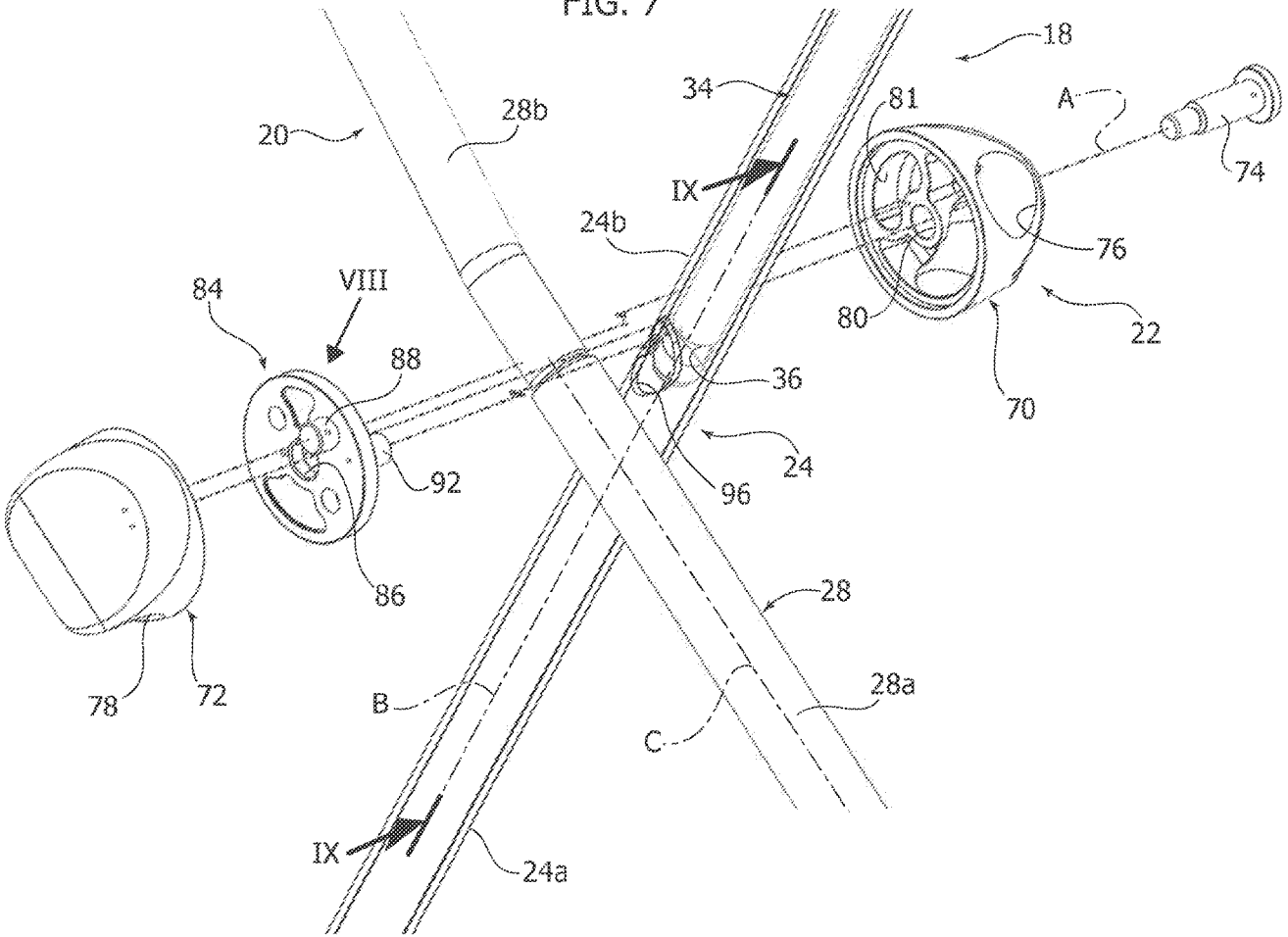
FIG. 7 is an exploded perspective view of the part indicated by the arrow VII in FIG. 4.
Figure 8:
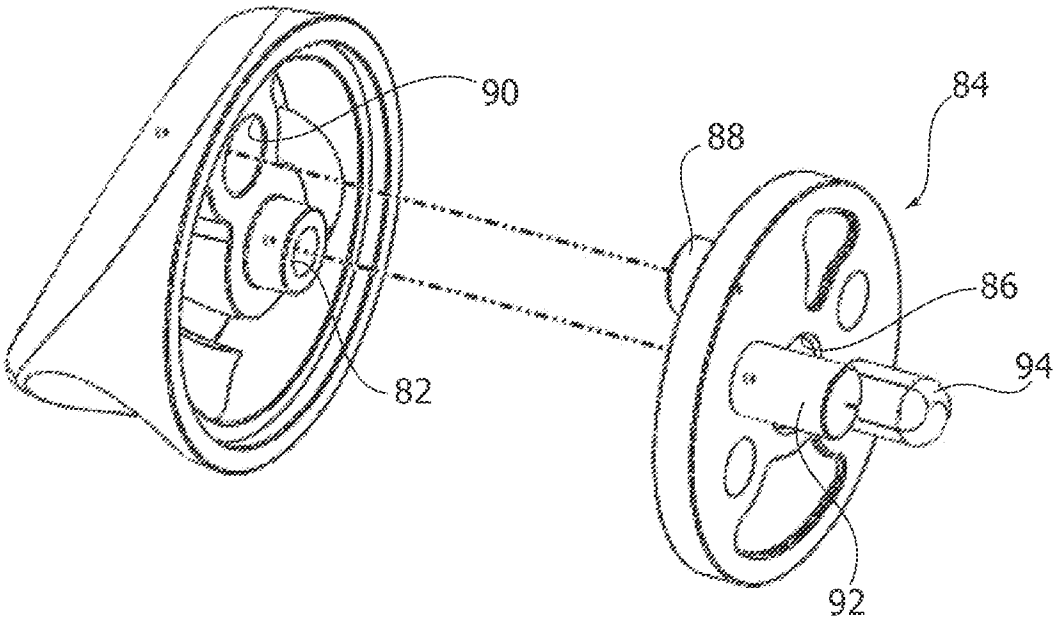
FIG. 8 is a perspective view from a different angle of the element indicated by the arrow VIII in FIG. 7.

With reference to FIG. 7, each joint 22 comprises a first half-joint 70 fixed to a respective first side element 24 and a second half-joint 72 fixed to a respective second side element 28. The two half-joints 70, 72 are coupled together rotatably about the transverse axis A by a respective pin 74. With reference to FIGS. 7 and 8, the pin 74 has a shank which rotatably engages a hole 80 of the first half-joint 70 and one end that is inserted and fixed into a hole 82 of the second half-joint 72.

Figure 9:
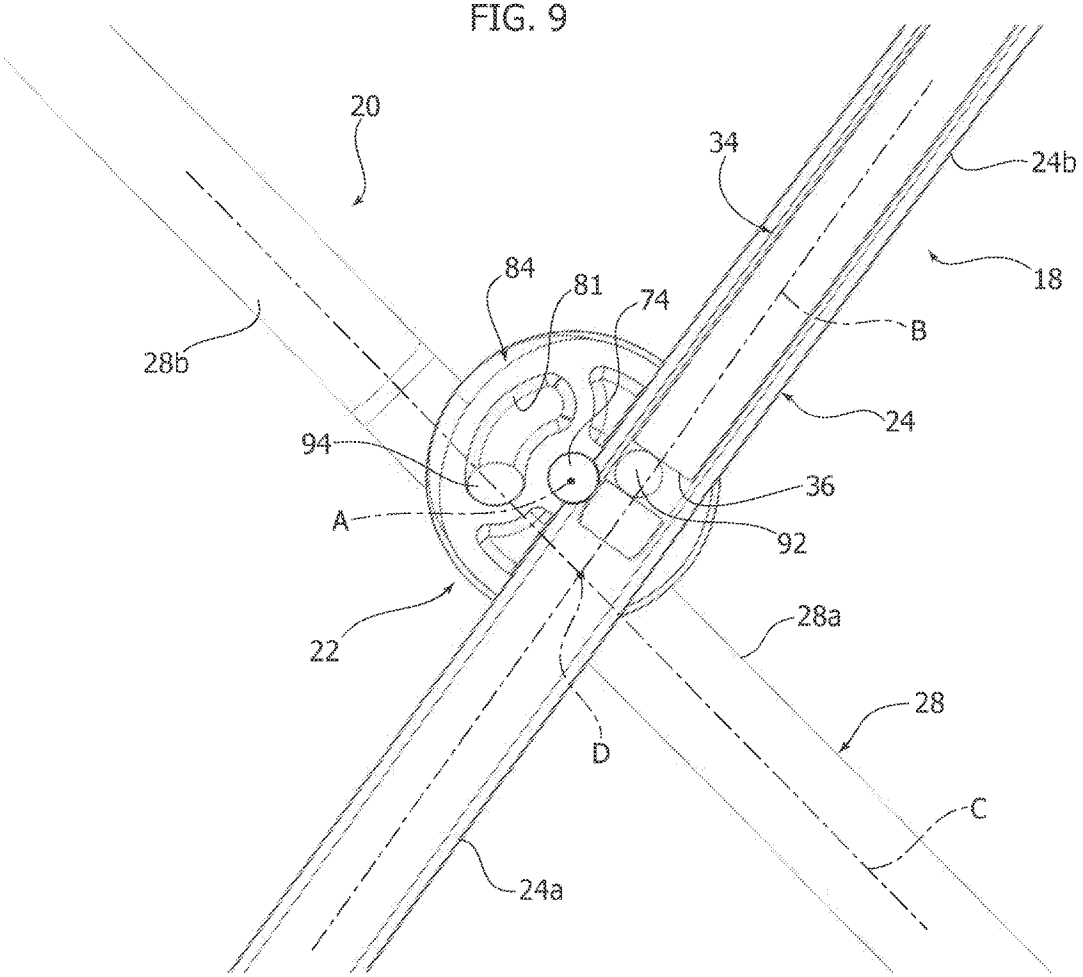
FIGS. 9 and 10 are cross-sections according to the line IX-IX of FIG. 7 in the open position and in the closed position, respectively.
Figure 10:
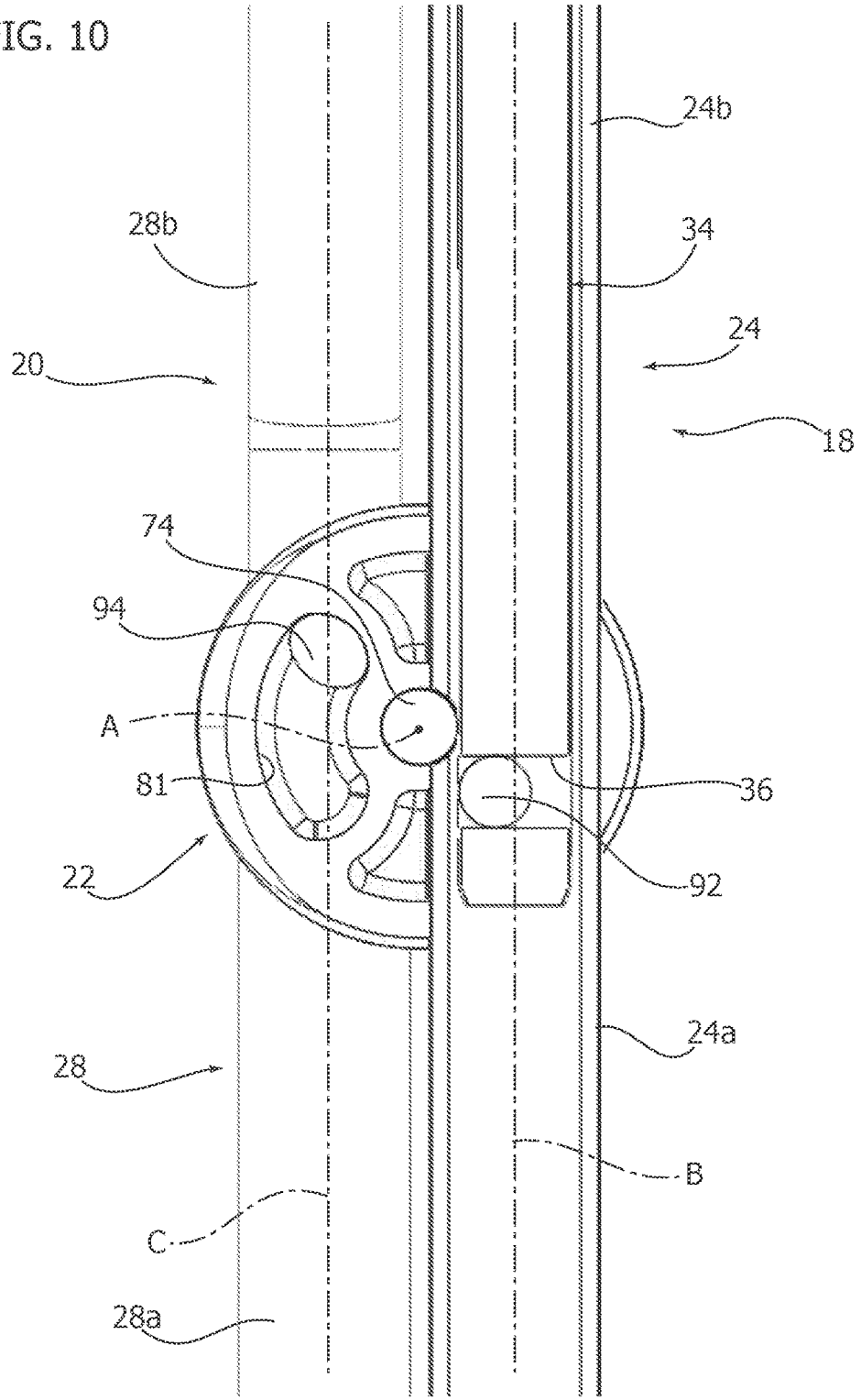

Preferably, the two half-joints 70, 72 are provided with respective through-holes 76, 78 in which the first side element 24 and the second side element 28 are, respectively, inserted and fixed. The two half-joints 70, 72 are rotatable relative to each other about the axis A, which coincides with the longitudinal axis of the pin 74. The axes of the holes 76, 78 are transverse and eccentric with respect to the axis A. With reference to FIGS. 9 and 10, the longitudinal axes B and C of the first side element 24 and of the second side element 28 are spaced apart from the transverse axis A. In the open position of FIG. 9, the point D—defined by the intersection between the longitudinal axes B and C of the first and second side elements 24, 28—is spaced apart from the transverse axis A.

The second half-joint 72 carries a disc 84 having a central hole 86, which is passed through by the end portion of the pin 74. The disc 84 has an inner face facing the first half-joint 70 and an outer face facing the second half-joint 72. The disc 84 is rotationally fixed with respect to the second half-joint 72. The rotational mounting of the disc 84 with respect to the second half-joint 72 is obtained by means of a pin 88 projecting from the outer face of the disc 84, which engages an eccentric hole 90 (FIG. 8) of the second half-joint 72. The disc 84 has an actuating pin 92 and a stop pin 94 parallel to and eccentric with respect to the axis A and projecting from the inner face of the disc 84. The actuating pin 92 extends through a hole 96 formed on the side wall of the first side element 24 and engages the engagement portion 36 formed at the lower end of the rod 34. The stop pin 94 engages an arcuate seat 81 formed in the first half-joint 70.

The operation of the chair 10 according to the present invention is as follows. The chair 10 is capable of assuming an open position illustrated in FIG. 1 and a closed position illustrated in FIG. 2. To switch from the open position to the closed position, and vice versa, the two structures 18, 20 are rotated relative to one another about the transverse axis A. During the relative rotation of the structures 18, 20, the half-joints 70, 72 of each joint 22 rotate relative to one another about the transverse axis A. As illustrated in FIGS. 9 and 10, the relative rotation of the two half-joints 70, 72 of each joint 22 involves a rotation of the actuating pin 92 and the stop pin 94 about the transverse axis A. In the open position illustrated in FIG. 9, the stop pin 94 is in abutment against a lower end of the arcuate seat 81. The abutment between the pin 94 and the lower end of the arcuate seat 81 defines a stable open position of the two structures 18, 20. In this position, the actuating pin 92 is in a raised position. Since the actuating pin 92 is engaged in the engagement portion 36 of the respective rod 34, in the open position of the chair 10, the rods 34 are in a raised position. In the raised position, the rods 34 move the backrest 14 into a forward tilted position, as illustrated in FIGS. 1 and 5. In this position, the backrest 14 is tilted forwards with respect to the longitudinal axis B of the first side elements 24 by an angle indicated by a in FIG. 1. In this position, the backrest 14 is essentially perpendicular to the seat 16.

When the two structures 18, 20 are rotated into the closed position, the two half-joints 70, 72 of each joint 22 rotate relative to one another about the transverse axis A and are carried into the position illustrated in FIG. 10. In this position, the stop pin 94 is in abutment against an upper end of the arcuate seat 81 and defines a stroke-end position of the closed chair. In this position, the drive pin 92 is in a lowered position. During the movement from the open position to the closed position, the drive pin 92 moves the respective rod 34 downwards, within the respective first side element 24. In the closed position of the chair 10, the rods 34 are in the lowered position. In this position, the backrest 14 is aligned to the longitudinal axis C of the side elements 24, as shown in FIG. 2.

During the movement of the chair from the open position to the closed position, the seat 16 tilts about the second transverse element 30 located at the upper ends of the second side elements 28 and it is brought into a position parallel to the second side elements 28 as shown in FIG. 2. In the closed position, the first side elements 24 and the second side elements 28 are parallel to each other.

In the open position, the backrest 14 can be inclined backwards against an elastic force by a backward thrust applied by the user's back. In the rest position, the springs 44 push the respective bushings 40 upwards and the backrest supports 48 are in the position illustrated in FIG. 5. When the user applies a backward thrust against the backrest 14, the backrest 14 tilts backwards about a transverse pivot axis defined by the common axis of the pins 60. During the backward tilt of the backrest 14, the bushings 40 move downwards compressing the respective springs 44. The position of maximum backward inclination of the backrest is reached when the supports 48 come into abutment against the upper surfaces of the respective stop elements 42, as shown in FIG. 6. When the backward thrust applied by the user against the backrest 16 ceases, the springs 44 cause the backrest 14 to swing forward into the rest position illustrated in FIG. 5. The maximum forward inclination position of the backrest 14 is defined by the position of abutment of the bushings 40 against the respective stop elements 42.

The chair according to the present invention has a more comfortable sitting position compared to traditional folding chairs because in the open position the backrest 14 is essentially perpendicular to the seat 16. The greater sitting comfort in the open position does not increase the overall dimensions of the chair in the closed position because, during closing of the chair, the backrest 14 tilts backwards and in the closed position the backrest 14 is aligned with the side elements 24, 28.

Of course, without prejudice to the principle of the invention, the details of construction and the embodiments can be widely varied with respect to those described and illustrated, without thereby departing from the scope of the invention as defined by the claims that follow.

The invention claimed is:

1. A folding chair comprising:

a seat and a backrest carried by a folding structure, wherein the folding structure comprises a first structure defining a pair of front legs and a second structure defining a pair of rear legs, articulated to each other about a transverse axis by means of a pair of joints and movable relative to one another between an open position and a closed position, wherein the first structure comprises two first side elements and the second structure comprises two second side elements and wherein each of said joints comprises a first half-joint fixed to a respective first side element and a second half-joint fixed to a respective second side element, wherein the first and the second half-joints are rotatable relative to one another about said transverse axis, wherein the first structure comprises a pair of rods mounted within respective first side elements and movable between a raised position and a lowered position, wherein said joints cooperate with respective rods for controlling the movement of the rods from the raised position to the lowered position, and vice versa, as a consequence of the relative movement of the first structure and the second structure from the open position to the closed position, and vice versa, and wherein the backrest comprises two supports each of which is articulated to a respective first side element and to a respective rod, so that the movement of said rods from the raised position to the lowered position, and vice versa, controls the movement of the backrest with respect to the first structure between a position of use and a storage position, and vice versa.

2. A chair according to claim 1, wherein the second half-joint of each of said joints carries an actuating pin eccentric with respect to said transverse axis, which engages an engagement portion formed at a lower end of a respective rod.

3. A chair according to claim 2, wherein the second half-joint of each of said joints carries a stop pin, which engages an arcuate seat formed in the corresponding first half-joint.

4. A chair according to claim 3, wherein said actuating pin and said stop pin are carried by a disc fixed with respect to said second half-joint.

5. A chair according to claim 1, wherein each of said supports of the backrest comprises a front articulation element articulated about a transverse axis to an upper end of a respective first side element and a rear articulation element articulated to an upper end of a respective rod.

6. A chair according to claim 5, wherein each of said rods comprises a bushing movable in a longitudinal direction with respect to an upper end portion of the rod and articulated to a respective rear articulation element of a respective support, each of said bushings being associated with an elastic element that elastically pushes the bushing towards a raised position.

7. A chair according to claim 1, wherein the seat has a front portion articulated to an upper end of said second structure and wherein a rear portion of the seat rests on a pair of shoes carried by respective first side elements and oscillating with respect to said first side elements about a transverse axis.

8. A chair according to claim 7, wherein said shoes slidably engage respective side edges of the seat in a longitudinal direction.

* * * * *